US009347419B2

(12) United States Patent
Kim et al.

(10) Patent No.: US 9,347,419 B2
(45) Date of Patent: May 24, 2016

(54) ELECTRIC FIELD GENERATING APPARATUS FOR COMBUSTION CHAMBER

(75) Inventors: Hongbin Kim, Anyang-si (KR); Sang Ken Kauh, Seoul (KR); Youn-Sok Choi, Seoul (KR); Kyoung-Min Shon, Seoul (KR)

(73) Assignees: Hyundai Motor Company, Seoul (KR); SNU R&DB Foundation, Seoul (KR)

( * ) Notice: Subject to any disclaimer, the term of this patent is extended or adjusted under 35 U.S.C. 154(b) by 834 days.

(21) Appl. No.: 13/524,343

(22) Filed: Jun. 15, 2012

(65) Prior Publication Data

US 2013/0146010 A1 Jun. 13, 2013

(30) Foreign Application Priority Data

Dec. 9, 2011 (KR) ..... 10-2011-0131752

(51) Int. Cl.

| | |
|---|---|
| ***F02P 15/00*** | (2006.01) |
| ***F02P 9/00*** | (2006.01) |
| ***F02P 23/04*** | (2006.01) |

(52) U.S. Cl.

CPC ..... *F02P 15/00* (2013.01); *F02P 9/002* (2013.01); *F02P 9/007* (2013.01); *F02P 23/045* (2013.01)

(58) Field of Classification Search

CPC ..... F02P 23/045; F02P 9/007; F02P 3/01; F02P 17/12; F02P 13/00; F02P 15/04; F02P 15/00

See application file for complete search history.

(56) References Cited

U.S. PATENT DOCUMENTS

| | | | | |
|---|---|---|---|---|
| 8,499,746 | B2 * | 8/2013 | Ikeda | F02B 23/08 123/143 B |
| 2004/0134469 | A1 * | 7/2004 | Tamol, Sr. | F02M 27/045 123/538 |
| 2010/0187968 | A1 * | 7/2010 | Ikeda | F02P 23/045 313/134 |
| 2011/0031886 | A1 * | 2/2011 | Ikeda | F01L 3/02 315/111.21 |
| 2012/0097140 | A1 * | 4/2012 | Kusunoki | F02P 9/002 123/620 |
| 2012/0112620 | A1 * | 5/2012 | Lykowski | F02P 23/04 313/141 |

FOREIGN PATENT DOCUMENTS

| | | | |
|---|---|---|---|
| JP | 55-12275 | A | 1/1980 |
| JP | 55-109723 | A | 8/1980 |
| JP | 56-12014 | A | 2/1981 |
| JP | 11-273828 | A | 10/1999 |
| JP | 2002-295259 | A | 10/2002 |
| JP | 2002-295264 | A | 10/2002 |
| JP | 2006-9651 | A | 1/2006 |
| JP | 2009-97420 | A | 5/2009 |
| KR | 10-2009-0077007 | A | 7/2009 |
| KR | 10-2009-0092518 | A | 9/2009 |

* cited by examiner

*Primary Examiner* — Stephen K Cronin
*Assistant Examiner* — Sizo Vilakazi
(74) *Attorney, Agent, or Firm* — Morgan, Lewis & Bockius LLP

(57) ABSTRACT

An electric field generating apparatus for a combustion chamber, may include an electric field generator located within a space of the combustion chamber where combustion flames may be produced to create electric fields within the space of the combustion chamber through an applied predetermined voltage, a lead-in wire connected to the electric field generator to flow the predetermined voltage to the electric field generator, and a high voltage providing unit connected to the lead-in wire for selectively applying the predetermined voltage to the lead-in wire in accordance with an output signal of a controller generated depending on an operation condition of an engine.

9 Claims, 10 Drawing Sheets

ELECTRIC FIELD GENERATING APPARATUS FOR COMBUSTION CHAMBER

CROSS-REFERENCE TO RELATED APPLICATIONS

The present application claims priority to Korean Patent Application Number 10-2011-0131752 filed Dec. 9, 2011, the entire contents of which application is incorporated herein for all purposes by this reference.

BACKGROUND OF THE INVENTION

1. Field of the Invention

The present invention relates to a combustion chamber for an internal combustion engine, and more particularly, to an electric field generating apparatus for a combustion chamber which controls flame propagation speed with electric fields applied into the combustion chamber, thereby increasing engine output and maximizing combustion efficiency.

2. Description of Related Art

In general, since a fuel and air mixed at a specific ratio are introduced into a space of a combustion chamber to be compressed and are ignited by an ignition plug to be burned in a gasoline engine, flames cannot but propagate after ignition of a spark plug during an explosion stroke.

If such a gasoline engine delays an ignition timing, the output and efficiency of the engine can be enhanced, whereas as a delay degree of an ignition timing becomes larger, a possibility of knockings also increases.

Due to such a contradictory operation, an ignition timing of a gasoline engine is regulated in a very limited range.

Generally, a reverse effect due to a delay of an ignition timing increases an amount of fuel with respect to an air/fuel ratio, thereby lowering an intake temperature and solving the problem.

However, if the reverse effect due to a delay of an ignition timing is solved by increasing an amount of fuel with respect to an air/fuel ratio, there occurs a limit where a fuel consumption rate increases due to the increased amount of fuel.

Meanwhile, a gasoline engine can enhance the output and efficiency of the engine by using a spark plug due to characteristics where the spark plug is applied.

Further, a lean-burn engine can enhance a flame propagation speed in a lean-burn region by mixing oxygen and hydrogen and lower a fuel consumption rate at the same time.

However, the above-mentioned methods of enhancing combustion efficiency have limits respectively and thus cannot reach a performance to be achieved.

As an example, the spark plug has a limit where a method of utilizing a local ionizing effect through change in shape, adjustment of a gap, and regulation of applied voltage and current achieves the effect only in a local region, and a lean-burn engine is disadvantageous in aspects of cost and management since it requires an additional substance in addition to a gasoline fuel.

An example of using electric fields may include Patent Document (KR 10-2009-0077007 (Jul. 13, 2009)).

The Patent Document discloses that a pair of first and second metal meshes are arranged in a fuel line, an electricity supply source for supplying electric power is connected to the first metal mesh and the second metal meshes, and electric fields are created between the first metal mesh and the second metal mesh by an operation of the electricity supply source, whereby the sizes of fuel particles injected from an injector are decreased, fuel efficiency and engine output are increased, and electric fields are used to improve discharge of a contamination source.

In particular, although the patent document uses electric fields, as the electric fields are used to reduce the sizes of fuel particles, there is a basic limit where a fuel efficiency enhancing effect through an interaction between electric fields and combustion flames within a combustion chamber cannot be accomplished at all.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an electric field generating apparatus for a combustion chamber which enhances combustion efficiency with a flame propagation speed delayed or promoted due to an influence of electric fields applied when flames are formed within the combustion chamber, thereby significantly increasing engine output and efficiency as compared to the same condition and lowering a fuel consumption rate, and maximizing an overall engine efficiency as well.

In an aspect of the present invention, an electric field generating apparatus for a combustion chamber, may include an electric field generator located within a space of the combustion chamber where combustion flames are produced to create electric fields within the space of the combustion chamber through an applied predetermined voltage, a lead-in wire connected to the electric field generator to flow the predetermined voltage to the electric field generator, and a high voltage providing unit connected to the lead-in wire for selectively applying the predetermined voltage to the lead-in wire in accordance with an output signal of a controller generated depending on an operation condition of an engine.

The electric field generator and the lead-in wire may include a conductive material to which the predetermined voltage is applied.

The conductive material may have thermal and chemical stability in a predetermined temperature oxidation environment.

The conductive material is a heat-resisting material.

The electric field generator is located around a spark plug for generating an ignition spark and producing the combustion flames within the combustion chamber, and is fixed by using the lead-in wire to be placed within the space of the combustion chamber.

The lead-in wire connects to the electric field generator via the spark plug.

The lead-in wire connects to the electric field generator via a portion where a gasket is inserted into a cylinder head and a cylinder block forming the combustion chamber.

The electric field generator is located around a spark plug for generating an ignition spark and producing the combustion flames within the combustion chamber and is fixed around the spark plug via an insulating body protruding from a cylinder head into the space of the combustion chamber to be placed within the space of the combustion chamber, and the lead-in wire is connected to the electric field generator.

The lead-in wire connects to the electric field generator via the spark plug.

The lead-in wire is surrounded by the insulating body to connect to the electric field generator.

The high voltage providing unit may include a high-voltage generator for generating the predetermined voltage, and a high-voltage controller connected to the high-voltage generator for selectively flowing the predetermined voltage of the high-voltage generator toward the lead-in wire in accordance with an output signal of the controller generated depending on the operation condition of the engine.

The high-voltage controller may include a switching device which connects a current flow direction of the high-voltage generator which is not connected to the lead-in wire when the output signal of the controller is applied, and disconnects the current flow direction of the high-voltage generator which is connected to the lead-in wire when the output signal of the controller is not applied.

The output signal of the controller is generated, considering an RPM of the engine, a valve variable timing, and an ignition delay timing.

The high-voltage controller is integrated with the high-voltage generator.

In another aspect of the present invention, an electric field generating apparatus for a combustion chamber, may include an electric field generator located around a spark plug for generating an ignition spark to produce combustion flames within a space of the combustion chamber where the combustion flames are produced to form an electric field within the space of the combustion chamber through an applied predetermined voltage, a lead-in wire connected to the electric field generator to flow the predetermined voltage to the electric field generator, an insulating body protruding from a cylinder head to the space of the combustion chamber around the spark plug to secure the electric field generator thereto, a high-voltage generator connected to the lead-in wire for generating the predetermined voltage, and a high-voltage controller connected to the high-voltage generator for selectively flowing the predetermined voltage of the high-voltage generator toward the lead-in wire in accordance with an output signal of a controller considering an RPM of an engine, a value variable timing, and an ignition delay timing.

The lead-in wire is surrounded by the insulating body and connects to the electric field generator through the insulting body, and the high-voltage controller is integrated with the high-voltage generator.

In further another aspect of the present invention, an electric field generating apparatus for a combustion chamber, may include an electric field generator located around a spark plug for generating an ignition spark to produce combustion flames within a space of the combustion chamber where the combustion flames are produced to form an electric field within the space of the combustion chamber through an applied predetermined voltage, a lead-in wire connected to the electric field generator to flow the predetermined voltage and exiting from a portion of a gasket located at an attaching portion between a cylinder block and a cylinder head into the space of the combustion chamber to fix the electric field generator, a high-voltage generator connected to the lead-in wire for generating the predetermined voltage, and a high-voltage controller connected to the high-voltage generator for selectively flowing the predetermined voltage of the high-voltage generator toward the lead-in wire in accordance with an output signal of a controller considering an RPM of an engine, a value variable timing, and an ignition delay timing.

The high-voltage controller is integrated with the high-voltage generator.

The high-voltage controller may be integrated with the high-voltage generator.

According to the exemplary embodiments of the present invention, an electric field generating apparatus for a combustion chamber enhances combustion efficiency with a flame propagation speed delayed or promoted due to an influence of electric fields applied when flames are formed within the combustion chamber, thereby significantly increasing engine output and efficiency as compared to the same condition and lowering a fuel consumption rate, and maximizing an overall engine efficiency as well.

Further, the present invention delays a flame propagation speed in a region where combustion efficiency is increased in case of a low flame propagation speed within the combustion chamber and promotes a flame propagation speed in a region where combustion efficiency is increased in case of a high flame propagation speed, thereby maximizing engine efficiency as compared to the same condition due to maximization of combustion efficiency of an entire region.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1A:
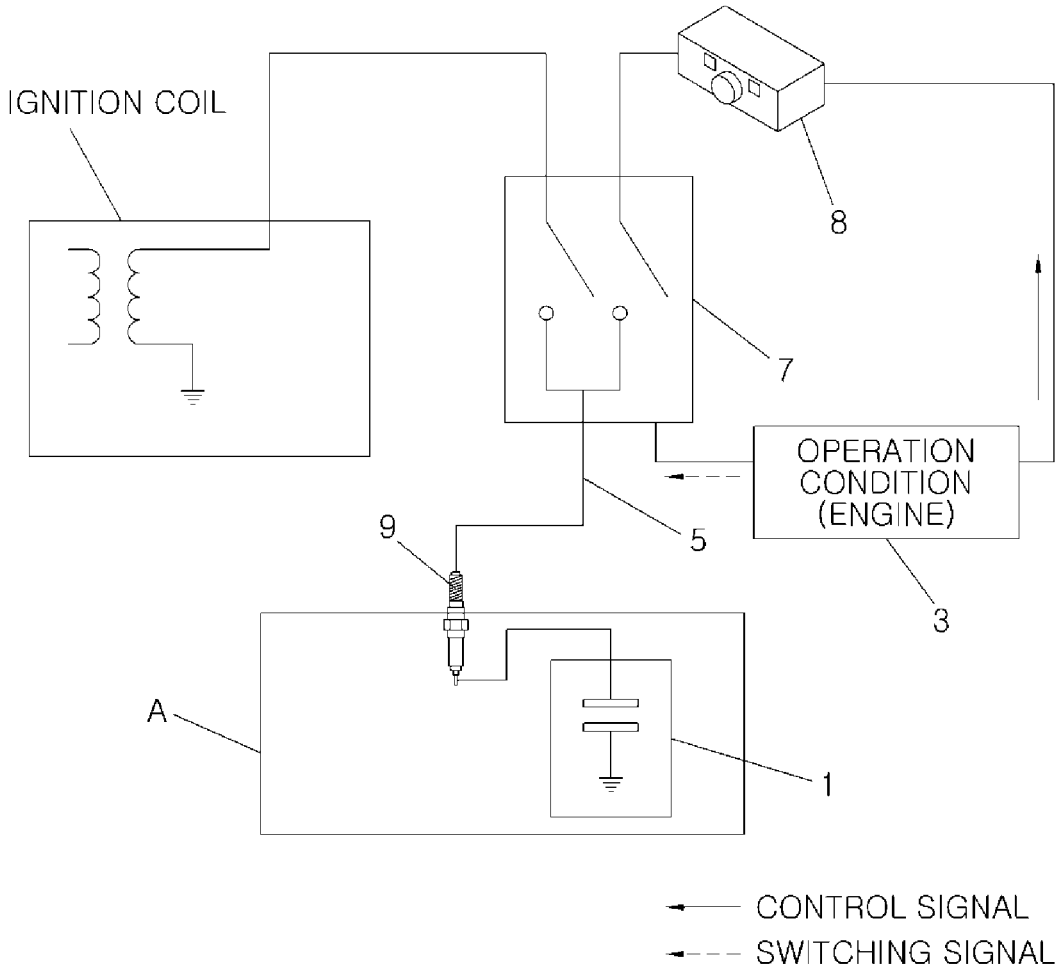
FIG. 1 is a view of an electric field generating apparatus for a combustion chamber according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Referring to FIG. 1A, an electric field generating apparatus for a combustion chamber includes an electric field generator 1 made of a conductive material to which a high voltage is applied to create electric fields within a space of a combustion chamber A, a lead-in wire 5 applied as a conductor to flow a high voltage to electric field generator 1, a high-voltage generator 8 for supplying a high voltage to lead-in wire 5, a spark plug 9 for producing flames by producing ignition sparks in combustion chamber A, and a high-voltage controller 7 switched by an output signal of a controller 3 generated according to an operation condition of an engine to convert a current flow direction of high-voltage generator 8 to lead-in wire 5.

Although combustion chamber A is a combustion chamber applied to all types of internal combustion engines for producing power due to combustion through flames, it will be described hereinbelow based on a combustion chamber of a gasoline engine.

Electric field generator 1 is made of a conductive material having durability at a high voltage of several Kv to several tens of Kv to be applied and having thermal/chemical stability even in an exposed high-temperature oxidation (combustion) environment, and a heat-resisting metal system is generally applied to electric field generator 1.

As an example, although electric field generator 1 may include a tantalum-based metal or a molybdenum-based metal as an example, various metals or non-metallic materials suitable for the purpose of electric field generator 1 may be employed.

Electric field generator 1 has a shape where a structure of combustion chamber A and a degree of influencing flames are considered.

The same conductive material as electric field generator 1 is applied to lead-in wire 5, and it is because a high voltage is applied to electric field generator 1 and lead-in wire 5 is exposed to a high-temperature oxidation (combustion) environment of combustion chamber A at the same time.

High-voltage controller 7 includes a switching device connected or separated when turned on or off.

Thus, high voltage controller 7 connects a flow direction of high-voltage generator 8 which is not connected to lead-in wire 5 when an output signal generated by controller 3 is applied, but disconnects a flow direction of high-voltage generator 8 connected to lead-in wire 5 when an output signal of controller 3 is not applied.

A switching control of high-voltage controller 7 is achieved by a switching signal output from controller 3, and an ECU (engine control unit) can use instead of controller 3.

The switching signal of controller 3 is a type of an output signal.

High-voltage controller 7 may include a relay connected or separated when turned on or off.

High-voltage generator 8 is a device for producing a high voltage of several Kv to several tens of Kv necessary for applying an electric field and generating a DC (or AC) waveform or a PWM pulse, and receives a control signal output from controller 3 to be operated.

The control signal of controller 3 is a type of output signal.

An ECU (engine control unit) can use instead of controller 3.

An operation timing of high-voltage generator 8 is determined, considering engine operation conditions such as an RPM of an engine, a variable timing of a valve, and an ignition delay timing.

A generated voltage, a waveform, and an applying time according to the determined operation timing are determined, considering an electric field forming condition of combustion chamber A, through controller 3.

Generally, controller 3 can make a decision by further considering various conditions influencing an engine in addition to the above-mentioned engine operation condition.

Figure 1B:
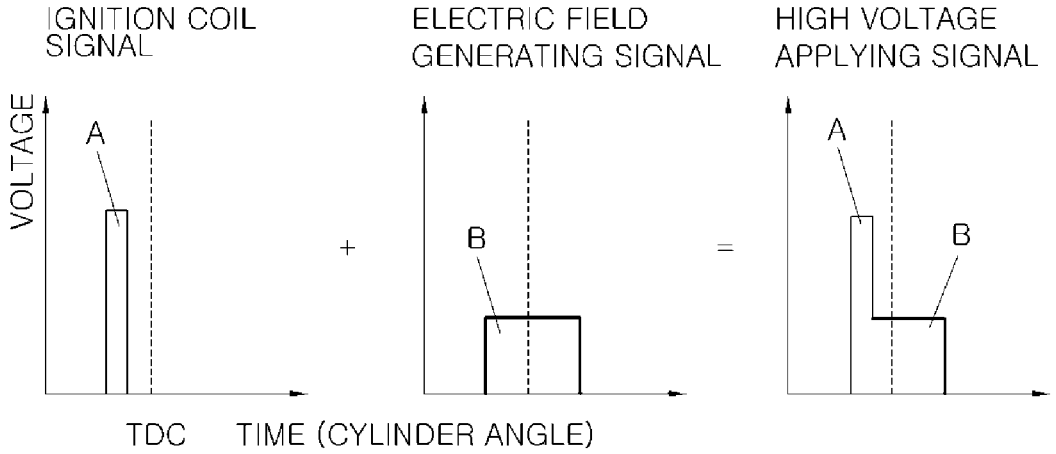

FIG. 1B shows an example of a control signal of controller 3, and it can be seen from FIG. 1B that a pulse of an ignition signal A applied to spark plug 9 and a pulse of an electric field applying signal B applied to high-voltage controller 7 may be different.

High-voltage generator 8 may be formed separately from high-voltage controller 7 to have a constitution independent from high-voltage controller 7, but may be incorporated and integrally formed with high-voltage controller 7 if necessary.

Spark plug 9 is a general spark plug, and is generally controlled by an ECU (engine control unit) with an ignition coil for generating ignition sparks.

Spark plug 9 is connected to lead-in wire 5 to apply a central electrode of spark plug 9 to lead-in wire 5 located within combustion chamber A.

The electric field generating apparatus for a combustion chamber may further include an insulating body for fixing a location of electric field generator 1 suspended within combustion chamber A and insulating lead-in wire 5 at the same time.

Insulation strength is also important to the insulating body because the insulation body is exposed to a high temperature oxidation (combustion) environment of combustion chamber A.

Thus, the insulating body is generally similar to an insulating body applied to spark plug 9, and ceramic may be applied as an example.

Figure 2:
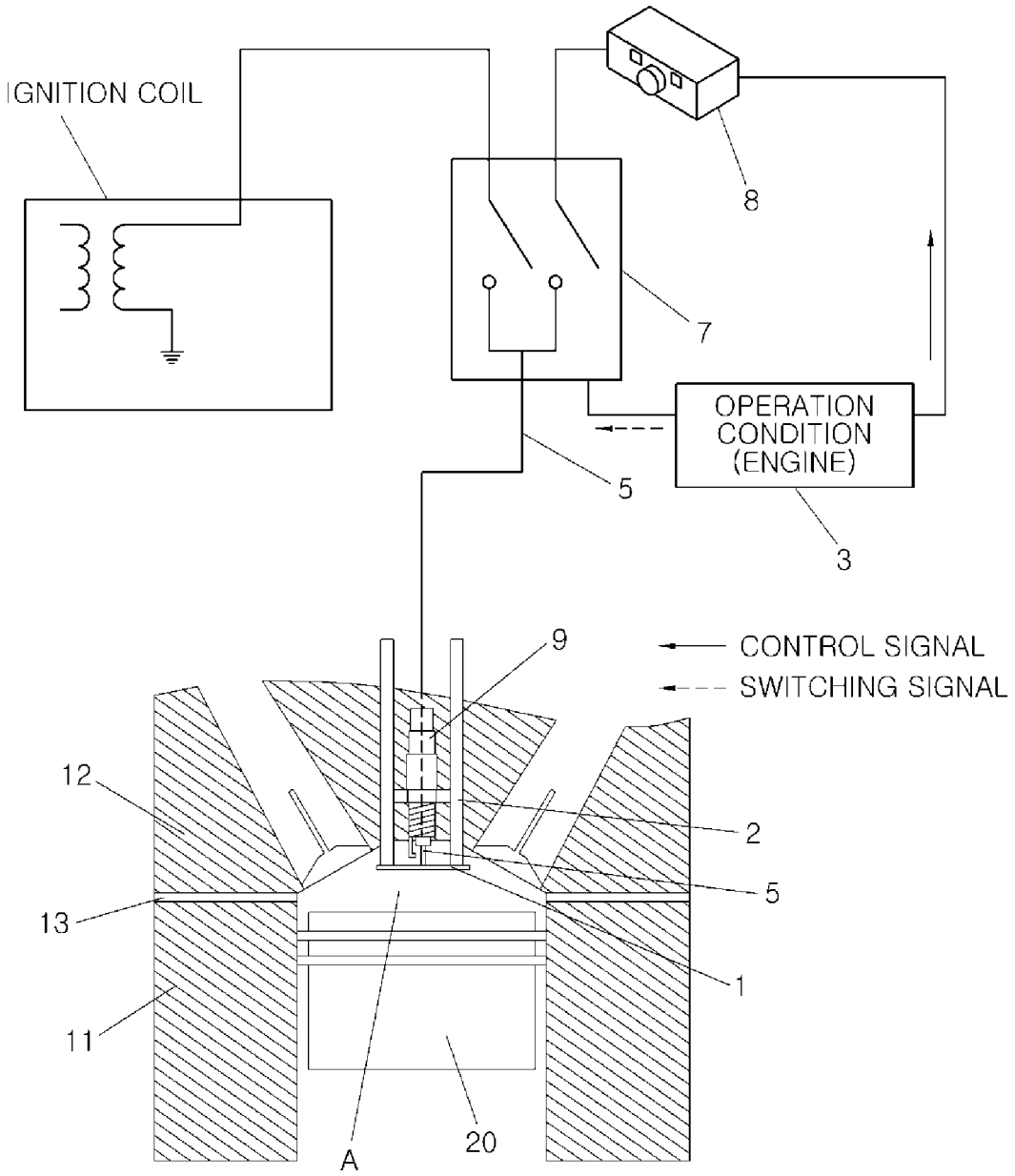
FIGS. 2 and 3 are diagrams showing that an electric field generating apparatus for a combustion chamber according to a various exemplary embodiments of the present invention is applied to an engine.

Meanwhile, referring to FIG. 2, the electric field generating apparatus for a combustion chamber according to the first exemplary embodiment of the present invention is classified into an external device installed outside an engine block because it is not directly operated with combustion chamber A of the engine block, and an internal device installed within the engine block because it is directly operated with combustion chamber A of the engine block.

The external device is classified into high-voltage generator 8 for supplying a high voltage to lead-in wire 5, and high-voltage controller 7 switched by an output signal of controller 3 to flow a high voltage to lead-in wire 5.

Meanwhile, the internal device is classified into electric field generator 1 for forming electric fields in a space of combustion chamber A, lead-in wire 5 serving as a conductor to flow a high voltage to electric field generator 1, and spark plug 9 for generating an ignition spark in combustion chamber A to produce flames.

If the internal device is actually mounted to the engine block, electric field generator 1 is located in an interior space of combustion chamber A where a piston 20 reciprocates between a cylinder block 11 and a cylinder head 12 classified by a gasket 13, and lead-in wire 5 exits from spark plug 9 located in the interior space of combustion chamber A using cylinder head 12 and connects to electric field generator 1.

Actually, electric field generator 1 is suspended in a space of combustion chamber A, and accordingly, an insulating body 2 for fixing and positioning electric field generator 1 cannot but be further required.

As insulating body 2 is installed around spark plug 9 using cylinder head 12, insulating body 2 performs an insulating function between lead-in wire 5 to which a high voltage is applied and cylinder head 12 having a ground potential in addition to a function of fixing electric field generator 1.

However, insulating body 2 is unnecessary if electric field generator 1 fixed by lead-in wire 5 can remains fixed in a high-temperature oxidation (combustion) environment while being suspended in a space of combustion chamber A.

Thus, the reason why the electric field generating apparatus for a combustion chamber further includes insulating body 2 entirely depends on the size of electric field generator 1.

Accordingly, insulating body 2 is required by electric field generator 1 having a size insufficient to maintain the fixed state only with the fixing force of lead-in wire 5.

Figure 3:
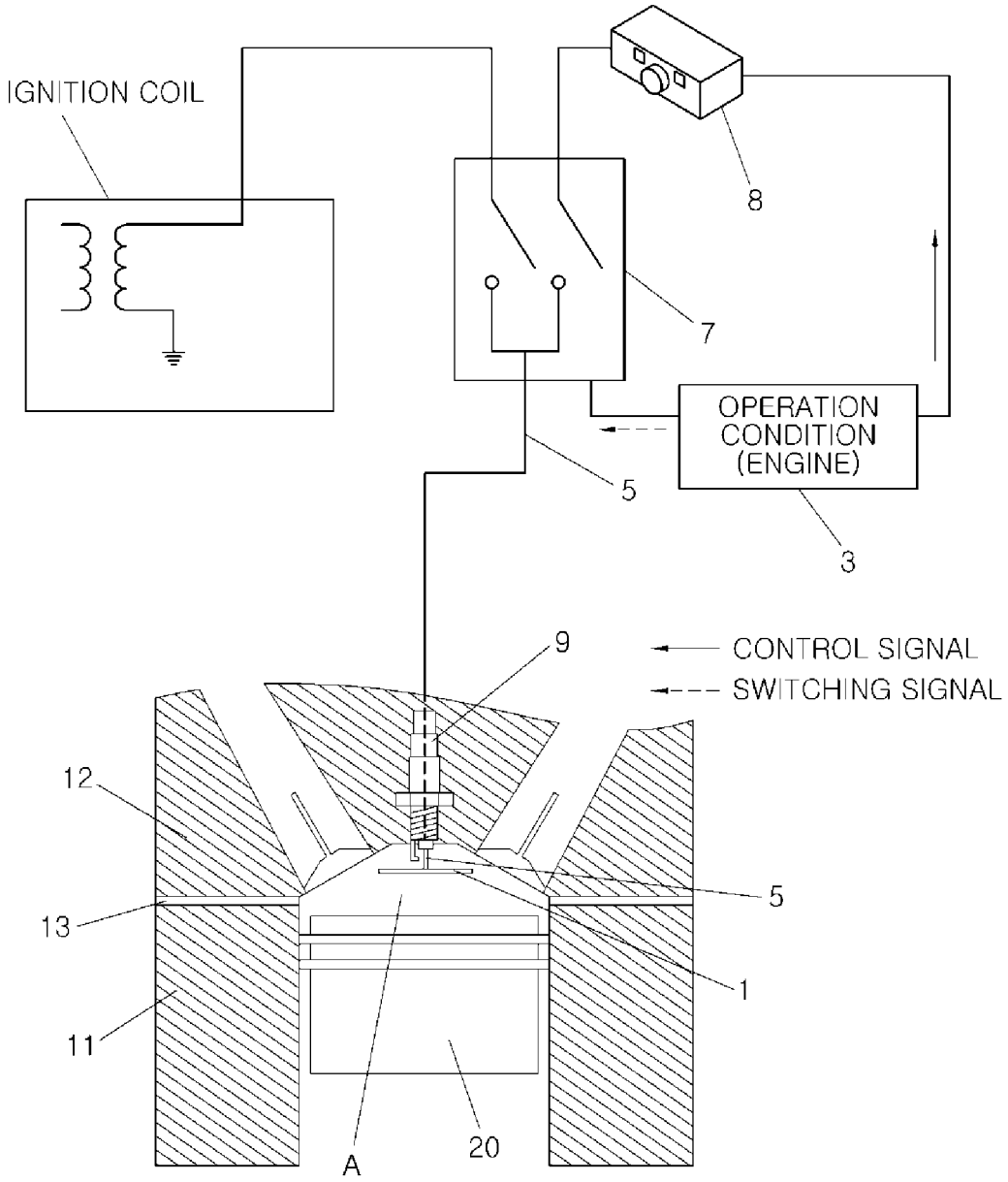

Referring to FIG. 3, it can be seen that the electric field generating apparatus does not include insulating body 2, and electric field generator 1 is fixed by using lead-in wire 5.

This is because electric field generator 1 has a very small size restricted to a portion of spark plug 9, such that electric field generator 1 can maintain a fixed state in a high-temperature oxidation (combustion) environment only with a fixing force of lead-in wire 5.

In the first exemplary embodiment, a central electrode of spark plug 9 is connected to lead-in wire 5 to be applied to an end portion of lead-in wire 5 forming an electric field to electric field generator 1.

In particular, as all of high-voltage generator 8, high-voltage controller 7, and spark plug 9 are independently constructed in the electric field generating apparatus for a combustion chamber according to the first exemplary embodiment, an ignition coil of spark plug 9 is rarely modified when the electric field generating apparatus for a combustion chamber is actually applied to a vehicle, making it possible to maximize the utility thereof.

Figure 4:
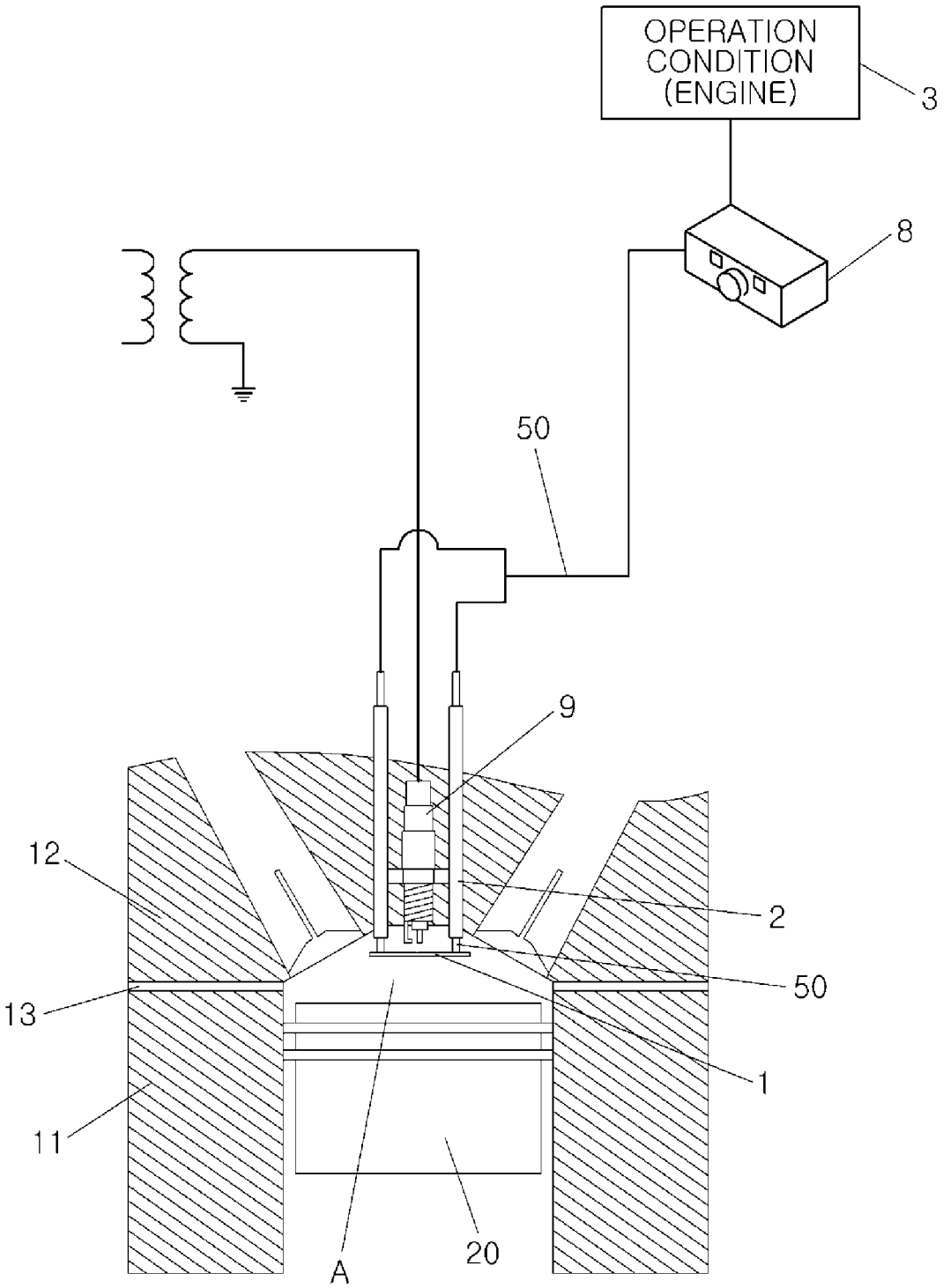
FIGS. 4 and 5 are diagrams showing that an electric field generating apparatus for a combustion chamber according to a various exemplary embodiments of the present invention is applied to an engine.

Meanwhile, referring to FIG. 4, an electric field generating apparatus for a combustion chamber according to a second exemplary embodiment is classified into an external device installed outside an engine block, and an internal device installed within an engine block in the same fashion as the first exemplary embodiment.

The internal device is classified into electric field generator 1 for forming electric fields in a space of combustion chamber A, lead-in wire 5 serving as a conductor to flow a high voltage to electric field generator 1, spark plug 9 for generating an ignition spark in combustion chamber A to produce flames, and insulating body 2 installed around spark plug 9 using cylinder head 12 to perform an insulating function.

However, unlike the first exemplary embodiment which uses spark plug 9, lead-in wire 5 is connected to electric field generator 1 while being surrounded by insulating body 2 in this case.

Another difference is that a construction of the external device is more simplified unlike the first exemplary embodiment.

That is, in the external device in this case, as high-voltage controller 7 switched by an output signal of controller 3 to flow a high voltage to lead-in wire 5 is integrally formed with high-voltage generator 8 supplying a high voltage, an element of the external device may be restricted only to high-voltage generator 8.

Figure 5:
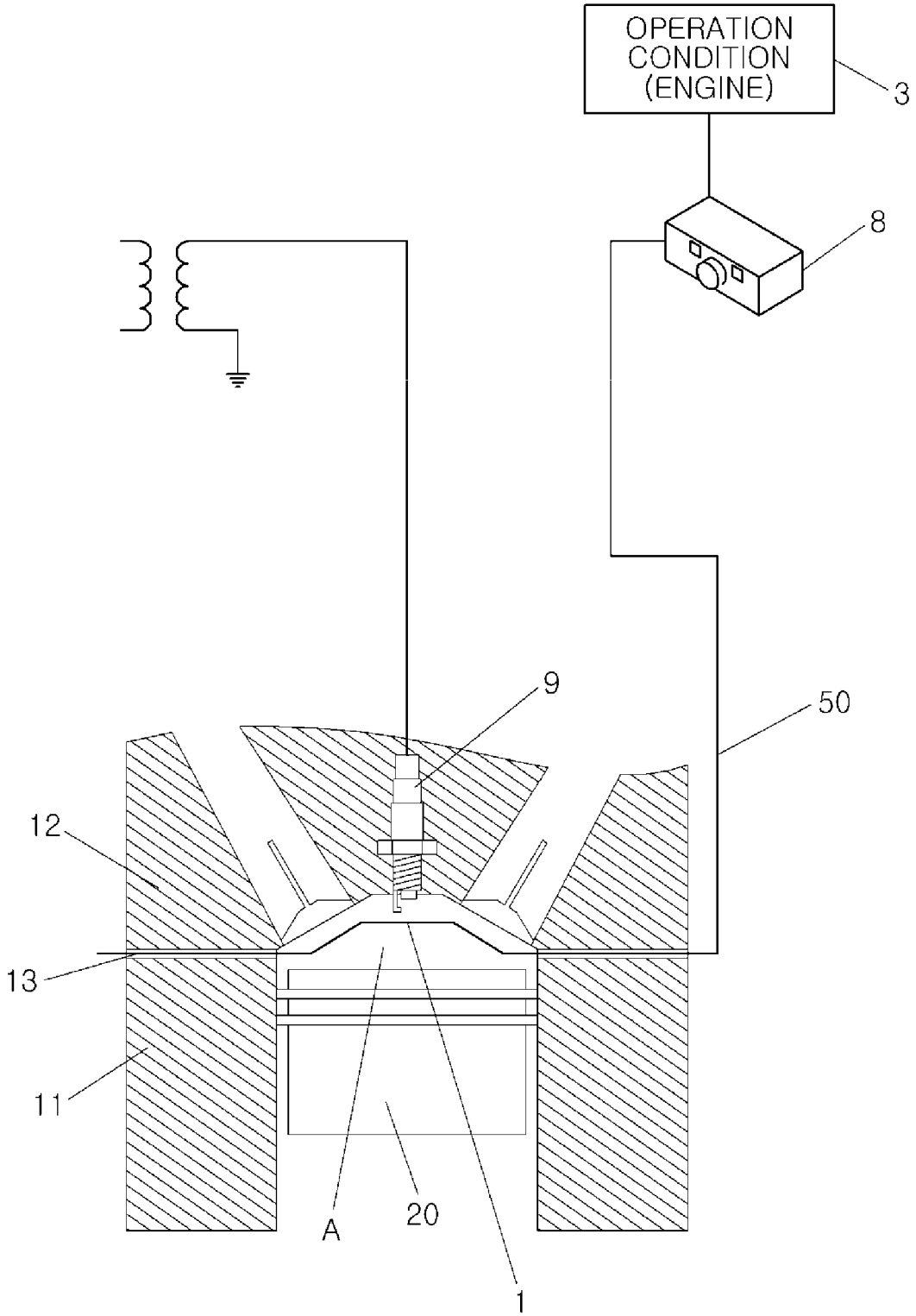

Referring to FIG. 5, it can be seen that the electric field generating apparatus for a combustion chamber according to the second exemplary embodiment does not include insulating body 2.

In the electric field generating apparatus, electric field generator 1 is fixed by using lead-in wire 5 without applying insulating body 2.

Thus, it can be seen that this case is caused not by the size of electric field generator 1 as in the first exemplary embodiment but by the layout of lead-in wire 5.

It is because, instead of using cylinder head 12 such that the layout of lead-in wire 5 is located around spark plug 9, a gasket 13 located at an attached portion of cylinder block 11 and cylinder head 12 is used.

The layout of lead-in wire 5 is configured such that lead-in wire 5 can be extracted from both sides of combustion chamber A toward a combustion space and the fixing state thereof can be maintained even in a high-temperature oxidation (combustion) environment by fixing electric field generator 1 with lead-in wire 5 extracted toward the combustion space of combustion chamber A.

Thus, the electric field generating apparatus for a combustion chamber having lead-in wire 5 to which such a layout is applied is not restricted at all by the size of electric field generator 1.

In the second exemplary embodiment, the central electrode of spark plug 9 is used only for an operation of producing ignition sparks.

In particular, since high-voltage generator 8 integrated with high-voltage controller 7 and spark plug 9 are independently constructed in the electric field generating apparatus for a combustion chamber according to the second exemplary embodiment, an ignition coil of spark plug 9 is rarely modified when electric field generating apparatus for a combustion chamber is actually applied to a vehicle, making it possible to maximize the utility thereof as in the first exemplary embodiment.

In the above-mentioned first and second exemplary embodiments, as spark plug 9 is treated as an independent part, an emphasis is placed on increasing an actual application of the electric field generating apparatus for a combustion chamber to a vehicle.

However, the electric field generating apparatus for a combustion chamber according to an exemplary embodiment of the present invention can also realize a feature where high-voltage generator 8 constructed together with high-voltage controller 7 can be integrated with an ignition coil of spark plug 9.

However, the electric field generating apparatus for a combustion chamber including one part where all of high-voltage controller 7, high-voltage generator 8, and the ignition coil of spark plug 9 are integrated has the most advantageous effect in minimization of the number of parts and control thereof, but cannot but have a limit by which an ignition coil of spark plug 9 is required to be improved and a currently applied ignition control system is required to be modified.

Meanwhile, experimental performance of the electric field generating apparatus for a chamber according to an exemplary embodiment of the present invention can be seen with reference to FIG. 6, and it is exemplified that the same performance is realized without considering a difference between electric field generators 1 and lead-in wire 5 according to the first and second exemplary embodiments.

Figure 6A:
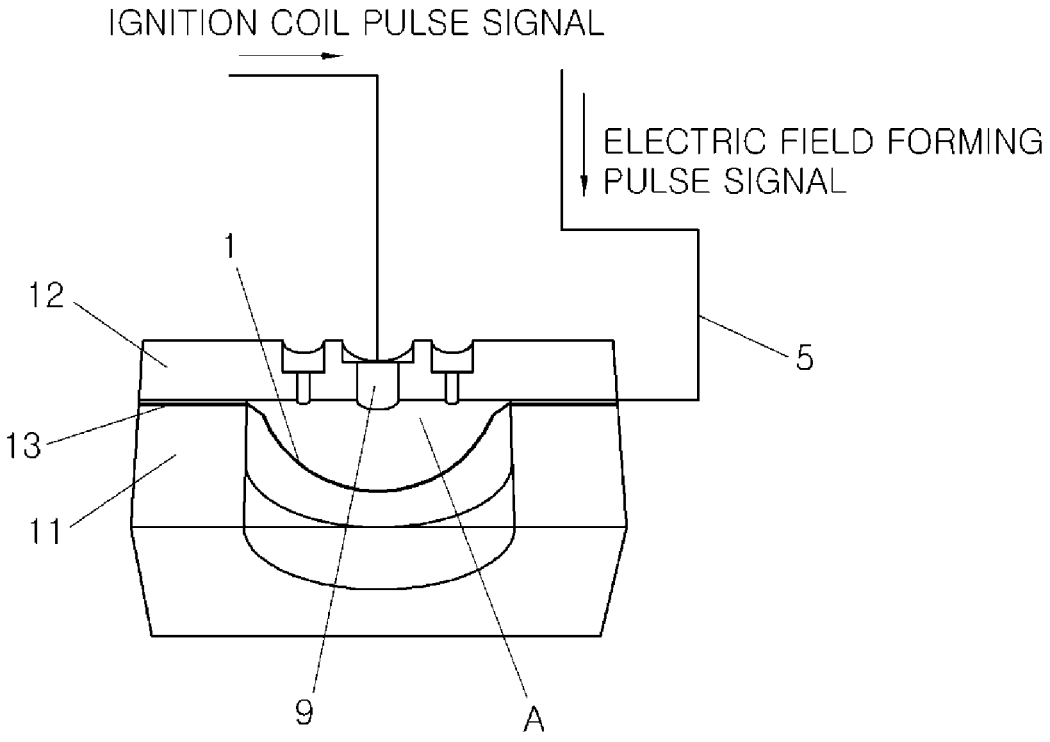
FIG. 6 is an experimental example of a conductive combustion chamber of the electric field generating apparatus for a combustion chamber according to an exemplary embodiment of the present invention.

It can be seen that in the layout of the electric field generating apparatus for a combustion chamber of FIG. 6A, electric field generator 1 is located in combustion chamber A formed by cylinder block 11 and cylinder head 12, spark plug 9 protruding into a space of combustion chamber A is installed in cylinder head 12, and lead-in wire 5 connects to a portion of gasket 13 inserted into cylinder block 11 and cylinder head 12 to be connected to electric field generator 1.

Figure 6B:
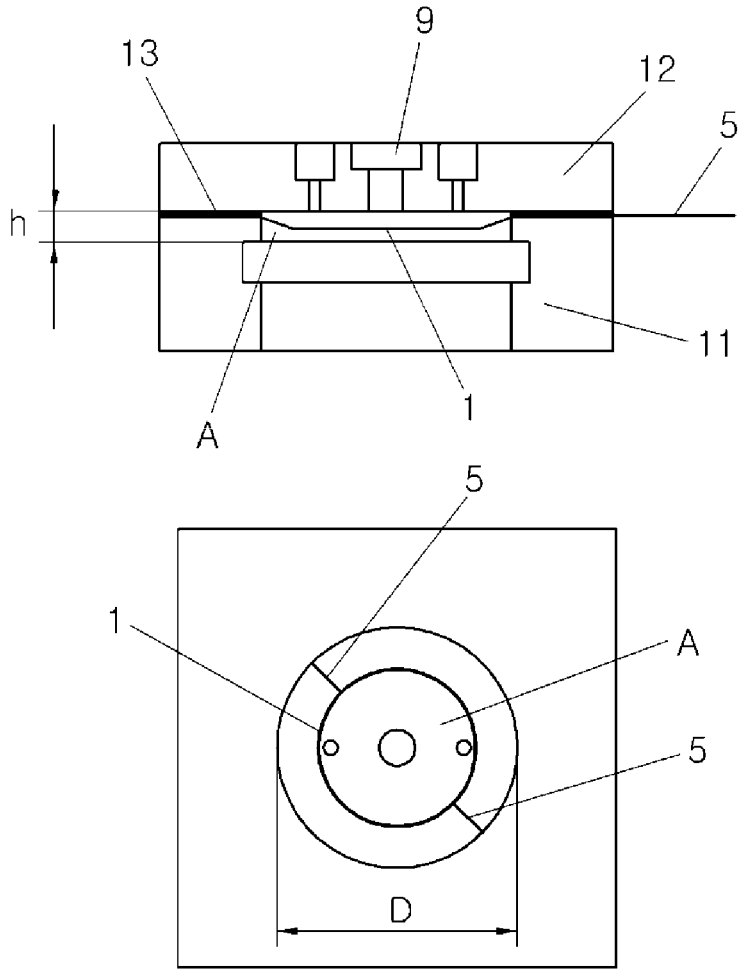

In particular, it can be seen that as combustion chamber A has a specific combustion chamber diameter D and a specific combustion chamber height h in a structure aspect of combustion chamber A of FIG. 6B, it has the same sectional structure as a combustion chamber of a general engine, and it can also be seen that electric field generator 1 is fixed by lead-in wire 5 to be suspended in a space of combustion chamber.

Figure 7:
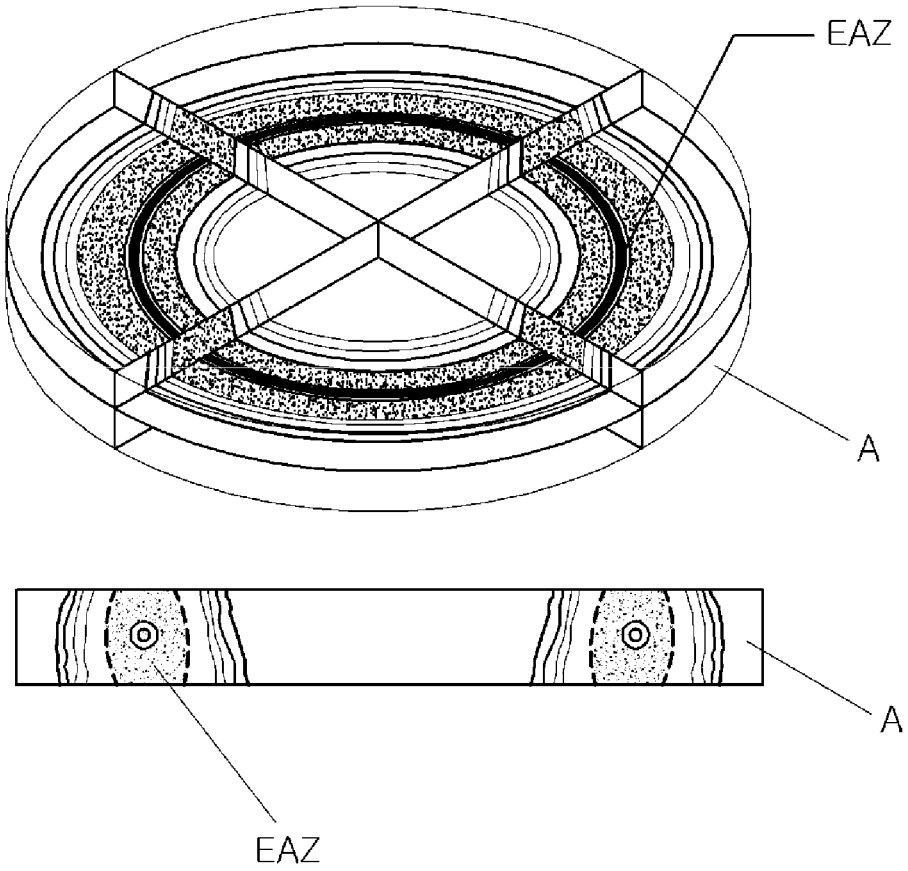
FIGS. 7 and 8 are performance graphs obtained according to experiments of conductive combustion chambers.

FIG. 7 is a combustion performance diagram based on FIG. 6, wherein it is assumed that combustion chamber A has a condition where combustion chamber diameter D is approximately 88 mm and combustion height h including a gasket height of 2 mm is approximately 11 mm, a fuel for combustion chamber A is homogeneously mixed methane $CH_4$, and a fuel injection condition for combustion chamber A is that methane $CH_4$ with a pressure of approximately 2 bar is injected into combustion chamber A through an injection hole of approximately 1 mm.

As in the shown simulation result, it can be seen that it has been experimentally proved that combustion performance is enhanced due to an operation of electric fields since EAZ (electric-field affected zone) exists in combustion chamber A, and it has also been proved that a strength of an electric field of the EAZ is further remarkable in a region of not less than approximately 100 kV/m during a methane combustion experiment.

Figure 8:
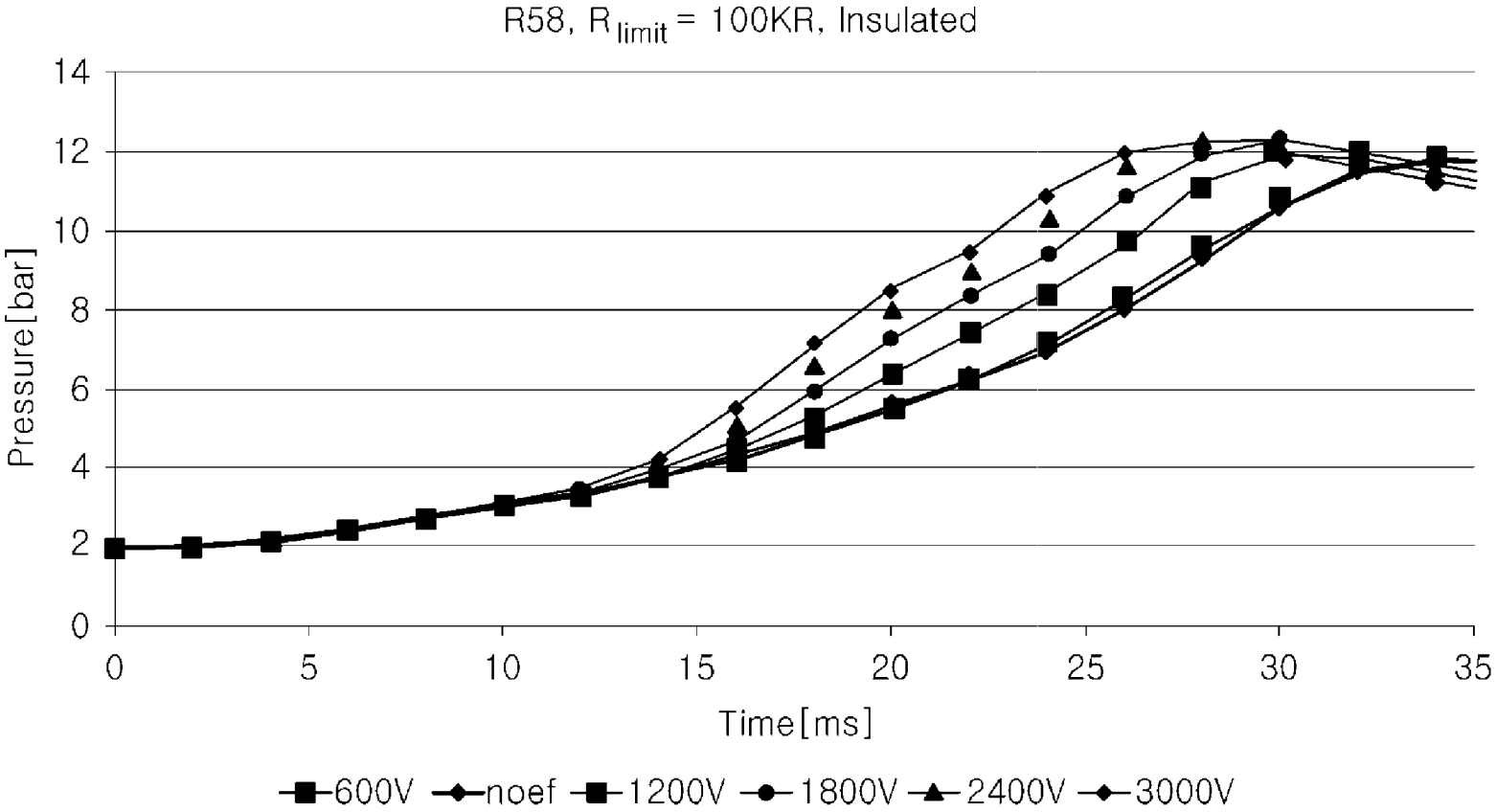

FIG. 8 is a combustion flame propagation graph based on FIG. 6, wherein it can be seen that a flame propagation speed increases around an electrode as an applied voltage of electric field generator 1 increases at pressure varying with time.

As mentioned above, as an electric field is created due to application of a voltage by electric field generator 1 located in a space of combustion chamber A in the electric field generating apparatus for a combustion chamber according to the present exemplary embodiment, a flame propagation speed of combustion chamber A increases around an electrode and combustion performance is enhanced by formation of an EAZ (electric-field affected zone) due to an operation of electric fields at the same time. In particular, engine output and efficiency can be significantly increased and a fuel consumption rate can be lowered as compared to the same condition, and engine efficiency can be maximized due to maximization of combustion efficiency of all regions through control of a flame propagation speed as well.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the claims appended hereto and their equivalents.

What is claimed is:

1. An electric field generating apparatus for a combustion chamber, comprising:

an electric field generator located within a space of the combustion chamber where combustion flames are produced to create electric fields within the space of the combustion chamber through an applied predetermined voltage;

a lead-in wire connected to the electric field generator to flow the predetermined voltage to the electric field generator; and a high voltage providing unit connected to the lead-in wire for selectively applying the predetermined voltage to the lead-in wire in accordance with an output signal of a controller generated depending on an operation condition of an engine, wherein the electric field generator is located around a spark plug for generating an ignition spark and producing the combustion flames within the combustion chamber, and is fixed to the lead-in wire to be placed within the space of the combustion chamber, and wherein the lead-in wire couples the electric field generator to a central electrode of the spark plug.

2. The electric field generating apparatus as defined in claim 1, wherein the electric field generator and the lead-in wire include a conductive material to which the predetermined voltage is applied.

3. The electric field generating apparatus as defined in claim 2, wherein the conductive material has thermal and chemical stability in a predetermined temperature oxidation environment.

4. The electric field generating apparatus as defined in claim 2, wherein the conductive material is a heat-resisting material.

5. The electric field generating apparatus as defined in claim 1, wherein the lead-in wire connects to the electric field generator via a portion where a gasket is inserted into a cylinder head and a cylinder block forming the combustion chamber.

6. The electric field generating apparatus as defined in claim 1, wherein the high voltage providing unit includes a high-voltage generator for generating the predetermined voltage, and a high-voltage controller connected to the high-voltage generator for selectively flowing the predetermined voltage of the high-voltage generator toward the lead-in wire in accordance with the output signal of the controller generated depending on the operation condition of the engine.

7. The electric field generating apparatus as defined in claim 6, wherein the high-voltage controller includes a switching device which connects a current flow direction of the high-voltage generator not connected to the lead-in wire when the output signal of the controller is applied, and disconnects the current flow direction of the high-voltage generator connected to the lead-in wire when the output signal of the controller is not applied.

8. The electric field generating apparatus as defined in claim 6, wherein the output signal of the controller is generated, considering an RPM of the engine, a valve variable timing, and an ignition delay timing.

9. The electric field generating apparatus as defined in claim 6, wherein the high-voltage controller is integrated with the high-voltage generator.

* * * * *